US007021361B2

(12) United States Patent
Hara et al.

(10) Patent No.: US 7,021,361 B2
(45) Date of Patent: Apr. 4, 2006

(54) MOLTEN METAL FEED APPARATUS OF DIE CASTING MACHINE, MOLTEN METAL FEED METHOD, AND LADLE

(75) Inventors: Kazuya Hara, Kanagawa (JP); Isamu Oonuma, Kanagawa (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/744,093

(22) Filed: Dec. 24, 2003

(65) Prior Publication Data

US 2004/0163791 A1 Aug. 26, 2004

(30) Foreign Application Priority Data

Dec. 26, 2002 (JP) ..... 2002-377841
Mar. 7, 2003 (JP) ..... 2003-062142

(51) Int. Cl.
*B22D 39/00* (2006.01)

(52) U.S. Cl. ..... 164/136; 164/336; 222/590; 222/629

(58) Field of Classification Search ..... 164/136, 164/336; 222/590, 629
See application file for complete search history.

(56) References Cited

U.S. PATENT DOCUMENTS 3,672,440 A * 6/1972 Miura et al. ..... 164/312
4,078,707 A * 3/1978 Ishikawa ..... 222/629
5,011,120 A * 4/1991 Bear ..... 266/240
5,381,855 A * 1/1995 Mezger ..... 164/457
6,779,585 B1 * 8/2004 Zumberger et al. ..... 164/136

* cited by examiner

*Primary Examiner*—Kevin Kerns
*Assistant Examiner*—I.-H. Lin
(74) *Attorney, Agent, or Firm*—Pillsbury Winthrop Shaw Pittman LLP

(57) ABSTRACT

A molten metal feed apparatus of a die casting machine preventing shortening of the lifetime of a sleeve due to local heating of the sleeve, provided with a ladle having a receptacle for holding the molten metal and a conveyor system for conveying the ladle to a predetermined feed position of the sleeve of the die casting machine and tilting the ladle to pour the scooped up molten metal into the sleeve, wherein the position of a front end of a pouring spout of the ladle with respect to the sleeve is changed in accordance with a change in posture of the ladle while pouring the molten metal into the sleeve.

8 Claims, 13 Drawing Sheets

MOLTEN METAL FEED APPARATUS OF DIE CASTING MACHINE, MOLTEN METAL FEED METHOD, AND LADLE

BACKGROUND OF THE INVENTION

1. Field of the Invention

The present invention relates to a molten metal feed apparatus of a die casting machine.

2. Description of the Related Art

In die casting machines, the molten metal is fed to a sleeve, then the molten metal is injected by a plunger into the cavity of a pair of dies for casting. As the molten metal feed apparatus for feeding the molten metal into the sleeve, for example, one using a ladle is known. In this molten metal feed apparatus, molten metal in the melting furnace is scooped up by a ladle, the ladle is conveyed to the sleeve by a conveyor system, then the ladle is tilted about a predetermined rotary shaft to pour the molten metal into the sleeve.

In a molten metal feed apparatus using a ladle, however, the rotary shaft is arranged at the position of the front end of the pouring spout of the ladle and the rotary shaft is driven by a chain so as to make the ladle tilt. Therefore, the front end of the pouring spout of the ladle is held at a substantially constant position for pouring the molten metal. If the position of the front end of the pouring spout of the ladle with respect to the sleeve is substantially constant, the drop position of the molten metal with respect to the sleeve becomes substantially constant and the molten metal drops in a restricted narrow area of the sleeve. If the molten metal drops in a restricted area of the sleeve, that area will become locally heated and easily damaged. This local heating becomes a cause of shortening the lifetime of the sleeve.

SUMMARY OF THE INVENTION

An object of the present invention is to prevent the lifetime of a sleeve from being shortened by local heating of the sleeve when feeding melt into a sleeve of a die casting machine.

To attain the above object, according to a first aspect of the present invention, there is provided a molten metal feed apparatus of a die casting machine having a ladle having a receptacle for holding a molten metal, a conveying means for conveying the ladle to a predetermined feed position of a sleeve of the die casting machine, tilting the ladle, and pouring the scooped up molten metal into the sleeve, and a position changing means for changing a position of a front end of a pouring spout of the ladle with respect to the sleeve in accordance with a change in posture of the ladle while pouring the molt n metal into the sleeve.

According to a second aspect of the invention, there is provided a molten metal feed method of a die casting machine having a steps of scooping up molten metal by a ladle held by a conveyor system, conveying the ladle to a predetermined feed position of a sleeve of the die casting machine, pouring the scooped up molten metal into the sleeve by tilting the ladle, and changing a position of a front end of a pouring spout of the ladle with respect to the sleeve in accordance with a change in posture of the ladle while pouring the molten metal into the sleeve.

According to a third aspect of the invention, there is provided a molten metal feed method of a die casting machine having a steps of scooping up molten metal by a ladle held by a conveyor system, conveying the ladle to a predetermined feed position of a sleeve of the die casting machine, pouring the scooped up molten metal into the sleeve by tilting the ladle, wherein the sleeve is moved in a predetermined range while pouring molten metal into the sleeve.

According to a fourth aspect of the invention, there is provided a ladle used for feeding molten metal to a sleeve of a die casting machine, having a receptacle for holding the molten metal, a mounting hole to which a rotary shaft is to be attached, and a pouring spout for pouring molten metal hold in the receptacle by rotation about the mounting hole, wherein the pouring spout has a front end being apart from an axial line of the mounting hole.

In the present invention, if tilting a ladle scooping up molten metal to pour the molten metal into a sleeve, the molten metal will drop toward the sleeve from the front end of the pouring spout of the ladle. At that time, if the position of the front end of the pouring spout of the ladle changes along with a change in posture of the ladle, the drop position of the molten metal with respect to the sleeve will also change and therefore the drop area of the molten metal will be enlarged and local heating of the sleeve will be prevented.

BRIEF DESCRIPTION OF THE DRAWINGS

These and other objects and features of the present invention will become clearer from the following description of the preferred embodiments given with reference to the attached drawings, wherein:

FIG. 2A is a cross-sectional view of the structure of the front end of a fifth arm of a conveyor system taken along a longitudinal direction of the fifth arm, while

FIG. 7A is a cross-sectional view of the structure of a front end of a fifth arm of a conveyor system according to a second embodiment of the present invention taken along the longitudinal direction of the fifth arm, while

FIG. 8A is a side view of the structure of a ladle seen from a mounting shaft side, while

DESCRIPTION OF THE PREFERRED EMBODIMENTS

Preferred embodiments of the present invention will be described in detail below while referring to the attached figures.

First Embodiment

Figure 1:
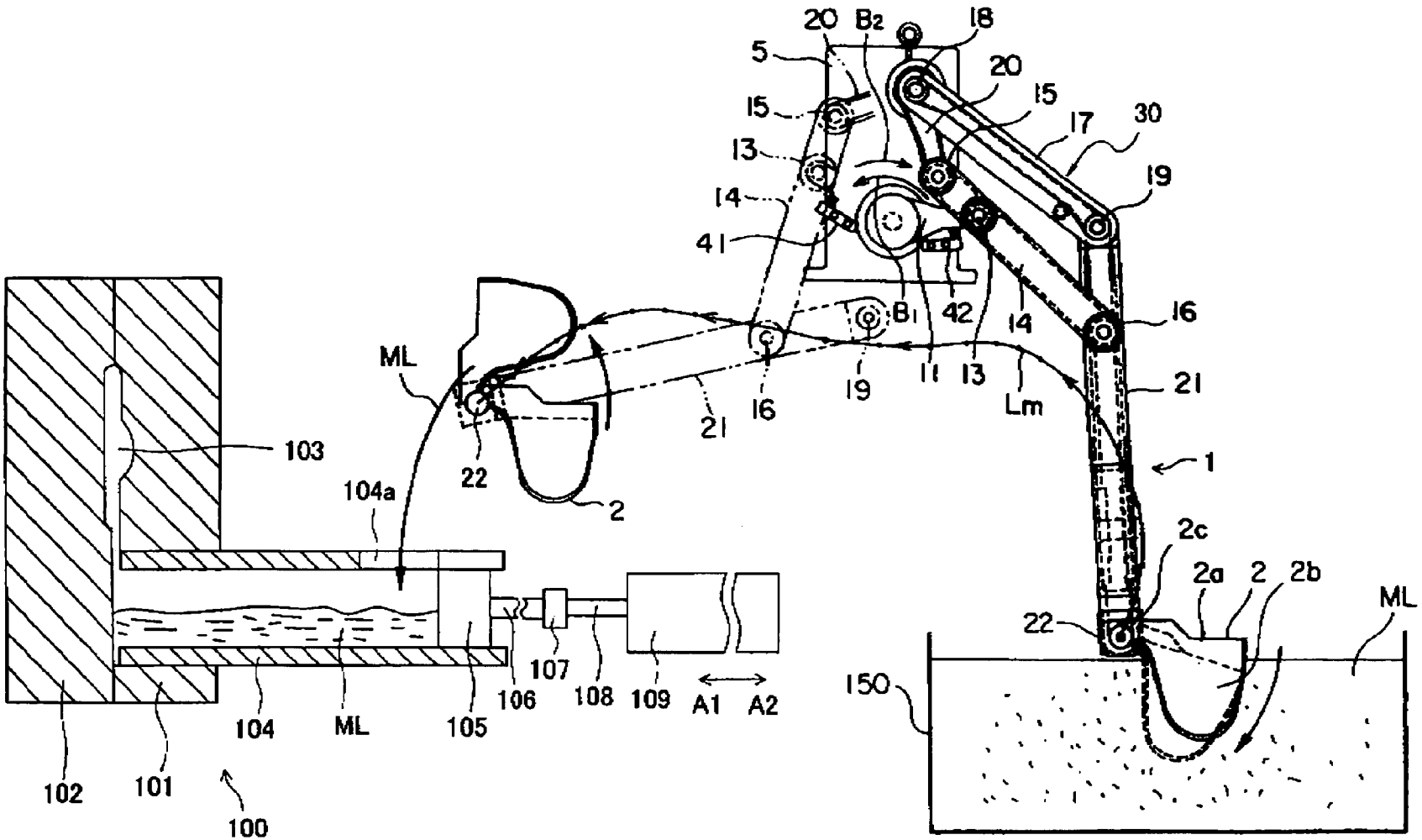
FIG. 1 is a view of the configuration of a molten metal feed apparatus of a die casting machine to which the present invention is applied.

FIG. 1 is a view of the configuration of a molten metal feed apparatus and a die casting machine according to an embodiment of the present invention. In FIG. 1, a die casting machine 100 is comprised of a fixed die 101, a movable die 102, a sleeve 104, a plunger 105, an injection cylinder 109, etc.

The fixed die 101 is held by a not shown fixed die plate of a die clamping system, while the movable die 102 is held by a not shown movable die plate of the die clamping system. The fixed die 101 and the movable die 102 are opened, closed, and clamped by the not shown die clamping system. The fixed die 101 and movable die 102 form a cavity 103 between them. This cavity 103 is communicated with the sleeve 104.

The sleeve 104 is for example a cylindrical member formed by a metal or other material. One end is positioned at the fixed die 101, while the other end is provided with an opening 104*a* for feeding molten metal. The plunger 105 is coupled to a front end of a plunger rod 106 and fits into an inner circumference of the sleeve 104. The plunger rod 106 is coupled with a piston rod 108 of an injection cylinder 109 by a coupling 107. The injection cylinder 109 houses a not shown piston coupled with a piston rod 108 and is driven by the supply of working oil from a not shown hydraulic circuit. Due to the drive action of the injection cylinder 109, the tip of the plunger 105 moves in the advancing direction A1 and the retracting direction A2. After molten metal ML is fed to the sleeve 104 through an opening 104*a*, the tip of the plunger 105 advances in the advancing direction A1, whereby molten metal ML is injected and filled into the cavity 103.

The molten metal feed apparatus is arranged near the sleeve 104 of the die casting machine 100. Further, a melting furnace 150 holding the molten metal ML is arranged at a predetermined position with respect to the sleeve 104. The molten metal feed apparatus 1 has a ladle 2 and a conveyor system 30 for conveying the ladle 2 between the sleeve 104 and melting furnace 150.

The conveyor system 30 is provided with a first arm 11, a second arm 14, a third arm 20, a fourth arm 17, and a fifth arm 21.

The first arm 11 is connected to a not shown servo motor through a speed reducer. By the drive action of this servo motor, the first arm 11 swivels in the direction of the arrows B1 and B2.

The front end of the first arm 11 is rotably coupled with a middle part of the second arm 14 in the longitudinal direction through a connecting shaft 13. This connecting shaft 13 is ratably held at either the first arm 11 or the second arm 14.

The third arm 20 is rotably coupled with a rotary shaft 18. The rotary shaft 18 is connected to the not shown servo motor through a speed reducer. The third arm 20 swivels about the rotary shaft 8 in a perpendicular plane. The front end of the third arm 20 is rotably coupled with one end of the second arm 14 through a connecting shaft 15.

The fourth arm 17, like the third arm 20, is rotably coupled with the rotary shaft 18. The fourth arm 17 swivels about the rotary arm 18 in a perpendicular plane. The front end of the fourth arm 17 is rotably coupled with one end of the fifth arm 21 through a rotary shaft 19. This rotary shaft 19 is rotably held at either of the fourth arm 17 or the fifth arm 21. Note that the rotary shaft 18 and rotary shaft 19 are provided with not shown sprockets. These sprockets have a chain wound around them. Therefore, when the rotary shaft 18 is driven, the rotational force is transmitted by the chain to the rotary shaft 19 whereby the rotary shaft 19 also rotates. The other end of the second arm 14 is rotably coupled with a middle part of the fifth arm 21 in the longitudinal direction through a connecting shaft 16.

Figure 2A:
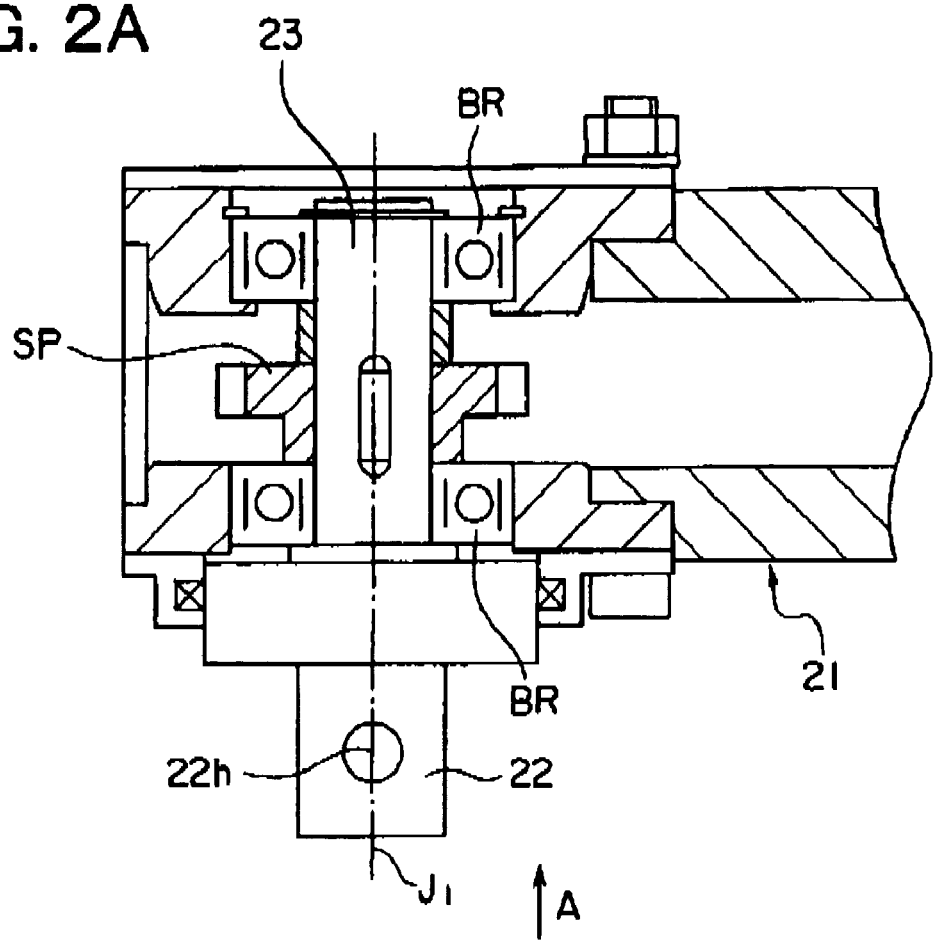
Figure 2B:
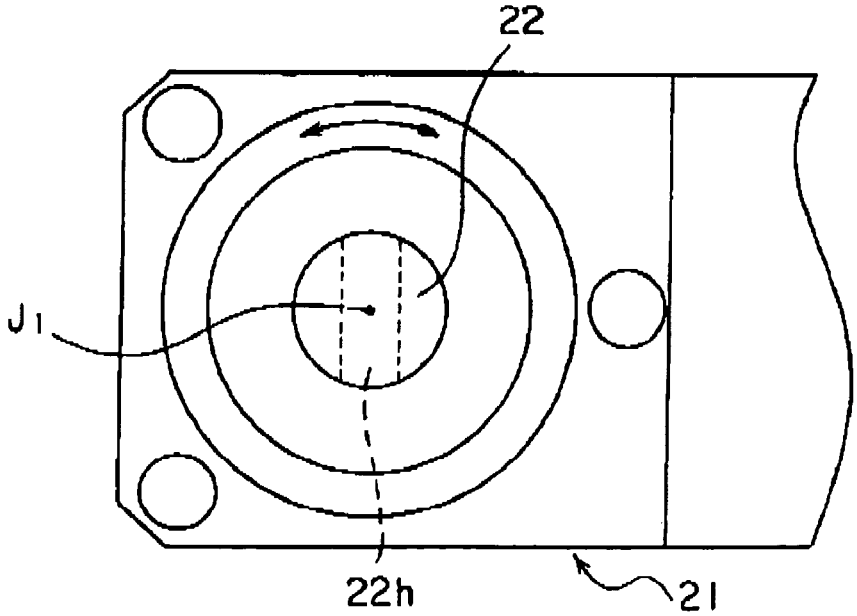
FIG. 2B is a side view seen from a direction A of FIG. 2A.

Here, FIG. 2A is a cross-sectional view of the structure of the front end of the fifth arm 21 of the conveyor system 30 along the longitudinal direction of the fifth arm 21, while FIG. 2B is a side view seen from the direction of the arrow A of FIG. 2A. As shown in FIGS. 2A and 2B, at the front end of the fifth arm 21, a rotary shaft 223 is arranged in a direction perpendicularly intersecting the longitudinal direction of the fifth arm 21. This rotary shaft 23 is rotably supported about an axial line J1 by a plurality of bearings BR.

The rotary shaft 23 has a sprocket SP fixed to it. This sprocket has a not shown chain wound around it. This chain is also wound around a not shown sprocket provided at the rotary shaft 19. Therefore, rotation of the rotary shaft 19 is transmitted through the chain to the rotary shaft 23. Further, one end of the rotary shaft 23 is provided with a mounting shaft 22. This mounting shaft 22 is provided concentrically with the axial line J1 of the rotary shaft 23. This mounting shaft 22 is formed with a pin hole 22*h* comprised of a through hole in a direction perpendicularly intersecting with the axial line J1. This pin hole 22*h*, as explained later, has a connection pin inserted in it.

Figure 3A:
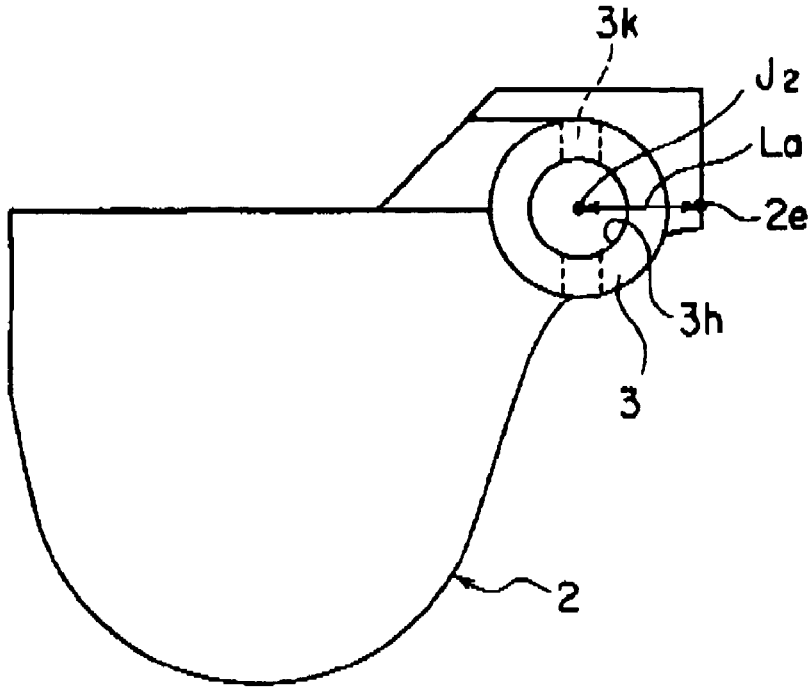
FIG. 3A is a cross-sectional view of the structure of the ladle seen from a mounting shaft side.
Figure 3B:
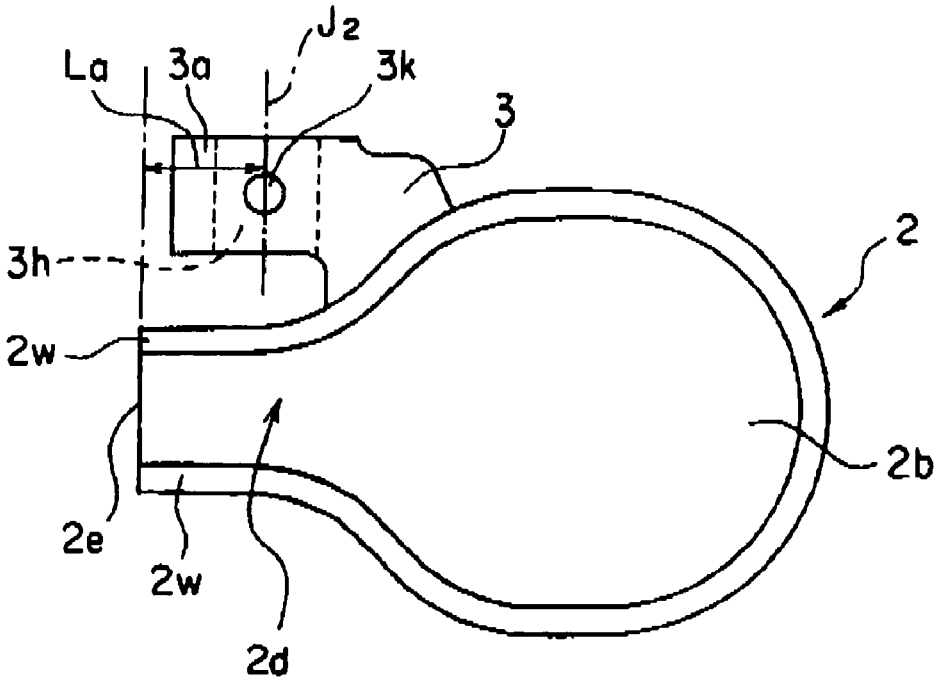
FIG. 3B is a top view.
Figure 3C:
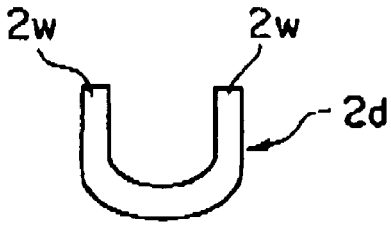
FIG. 3C is a side view of a pouring spout aide.

FIG. 3A is a cross-sectional view of the structure of the ladle 2 seen from the mounting shaft 22 side, FIG. 3B is a top view, and FIG. 3C is a side view of the pouring spout side. The ladle 2 is formed from a heat resistant material, for example, a ceramic. The top end is open. Inside there is a receptacle 2*b* for the molten metal. One side of the ladle 2 is formed with a pouring spout 2*d* in a region sandwiched between substantially parallel extending walls 2*w*.

As shown in FIG. 3B, one side surface of the ladle 2 has a mount 3 projecting out sideways formed integrally with it. The front end 3*a* of the mount 3 is formed with a mounting hole 3*h* in a direction substantially perpendicularly intersecting a wall part 2*w* (pouring spout 2*d*) of the ladle 2. This mounting hole 3*h* is for insertion of the above mentioned mounting shaft 22. The front and 2*a* of the pouring spout 2*d* is apart from the extension of the axial line J2 of the mounting hole 3*h* by exactly a predetermined distance La. Further, the front end 3*a* of the mount 3 is formed with a pin hole 3*k* comprised of a through hole in a direction perpendicularly intersecting the mounting hole 3*h*.

Figure 4:
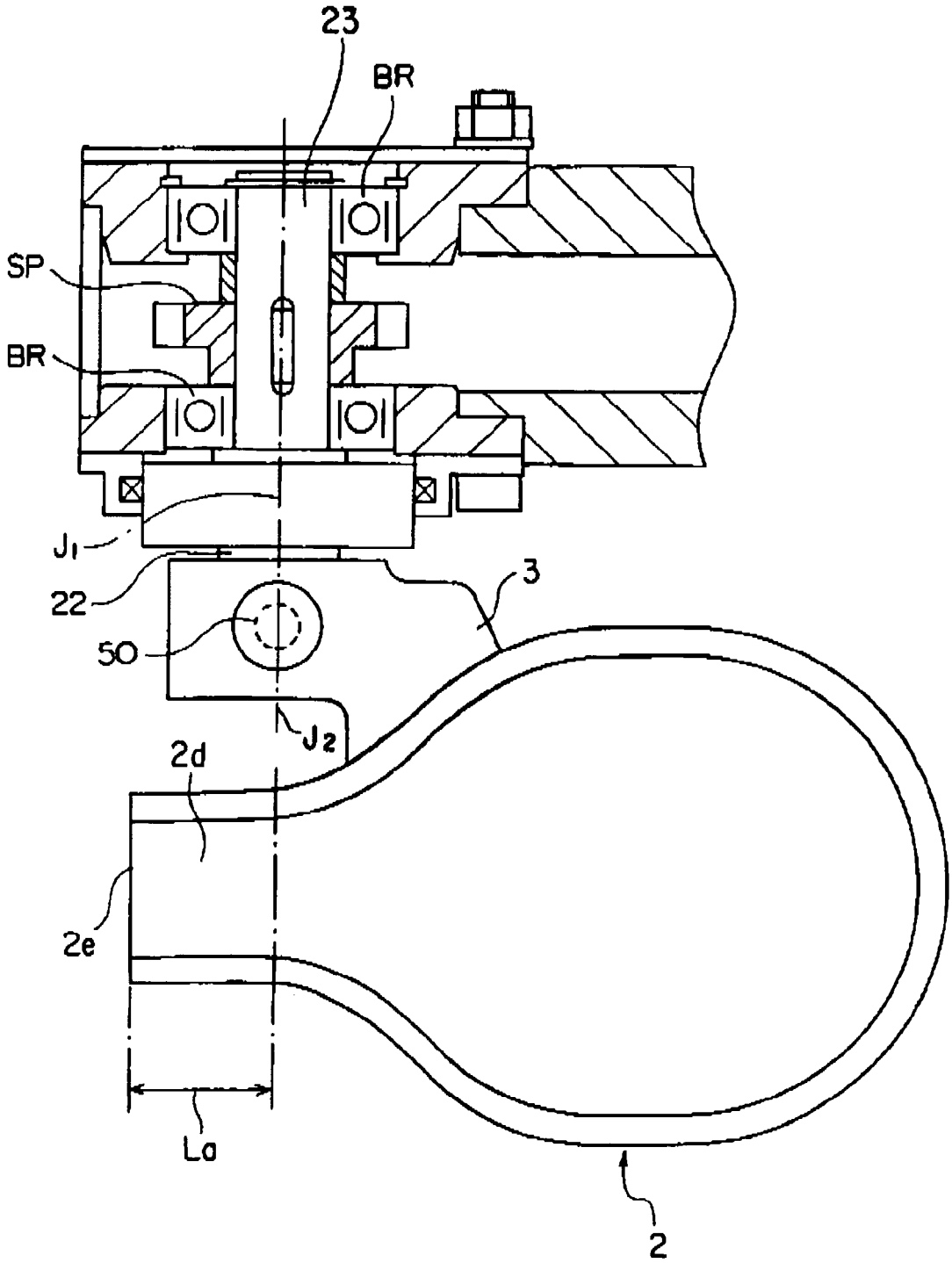
FIG. 4 is a view of the state of mounting a ladle to a mounting shaft of the conveyor system.

FIG. 4 is a view of the state of the ladle 2 of the above configuration mounted to the mounting shaft 22 of the conveyor system 30. As shown in FIG. 4, the mounting shat 22 is inserted into the mounting hole 3*h* of the ladle 2, then a connection pin 50 is inserted commonly in the pin hole 3*k* formed at the mount 3 of the ladle 2 and the pin hole 22*h* formed in the mounting shaft 22, whereby the ladle 2 is mounted to the mounting shaft 22. In the state shown in FIG. 4, the axial line J2 of the mounting hole 3*h* of the ladle is on the axial line J1 of the mounting shaft 22. Therefore, the axial line J2 of the mounting shaft 22 and the front end 2*e* of the pouring spout 2*d* of the ladle 2 are apart by exactly a distance La.

Next, the basic operation of the conveyor system 30 will be explained. In the conveyor system 30, when the rotary shaft 18 is driven by the servo motor, the rotational force transmitted to the rotary shaft 18 is transmitted through the sprocket and chain to the rotary shaft 19. The rotational force transmitted to the rotary shaft 19 is transmitted through the sprocket and chain to the mounting shaft 22. Due to the rotation of the mounting shaft 22, the ladle 2 is changed in posture.

On the other hand, when the first arm 11 swivels in the direction of the arrow B1 shown in FIG. 1, the mutually coupled second arm 14, third arm 20, fourth arm 17, and fifth arm 21 swivel coupled together. Due to this swivel action, the mounting shaft 22 and the ladle 2 provided at the front end of the fifth arm 21 are conveyed from the melting furnace 150 toward the sleeve. The conveyance path Lm is a path of movement of the mounting shaft 22 to which the ladle 2 is mounted. The conveyance path Lm is predetermined by the configuration of the coupling mechanism. Further, during conveyance of the ladle 2 along the conveyance path Lm, the ladle 2 is held constant in posture.

When feeding molten metal into the sleeve 104, as shown in FIG. 1, first the ladle 2 is dipped into the melting furnace 150 to scoop up the molten metal ML. Next, the ladle 2 scooping up the molten metal ML is conveyed along the conveyance path Lm to move the ladle 2 to a predetermined feed position for fading the molten metal ML to the sleeve 104. Next, the ladle 2 is tilted about the mounting shaft 22 to pour the molten metal ML into the opening 104*a* of the sleeve 104.

Figure 5:
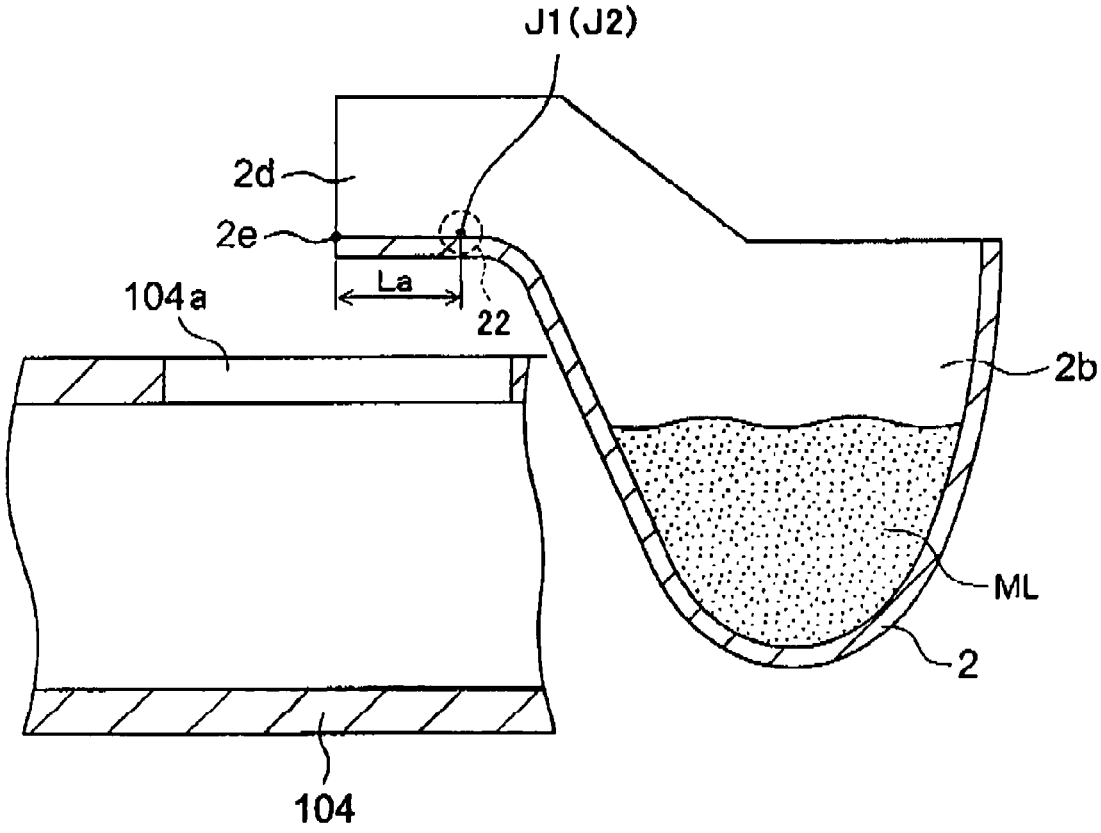
FIG. 5 is a view of the relationship between a ladle and a mounting shaft (rotary shaft)

FIG. 5 is a view of the relationship between the above ladle 2 and the mounting shaft 22 (rotary shaft 23). Note that FIG. 5 shows the state of the ladle 2 moved to a predetermined feed position for feeding the molten metal ML to the sleeve 104. The front end 2*e* of the pouring spout 2*d* of the ladle 2 is at the reference position (drop start position) for tilting the ladle 2 to pour the molten metal ML hold in the receptacle 2*b* to the sleeve 104. The drop position of the molten metal ML into the sleeve 104 is determined in accordance with the position of the front end 2*e* with respect to the sleeve 104. In the present embodiment, the front end 2*e* of the pouring spout 2*d* of the ladle 2 is provided at a position different from the axial line J1 of the mounting shaft 22. The position of the front end 2*e* of the pouring spout 2*d* of the ladle 2 changes in accordance with rotation of the mounting shaft 22.

Figure 6:
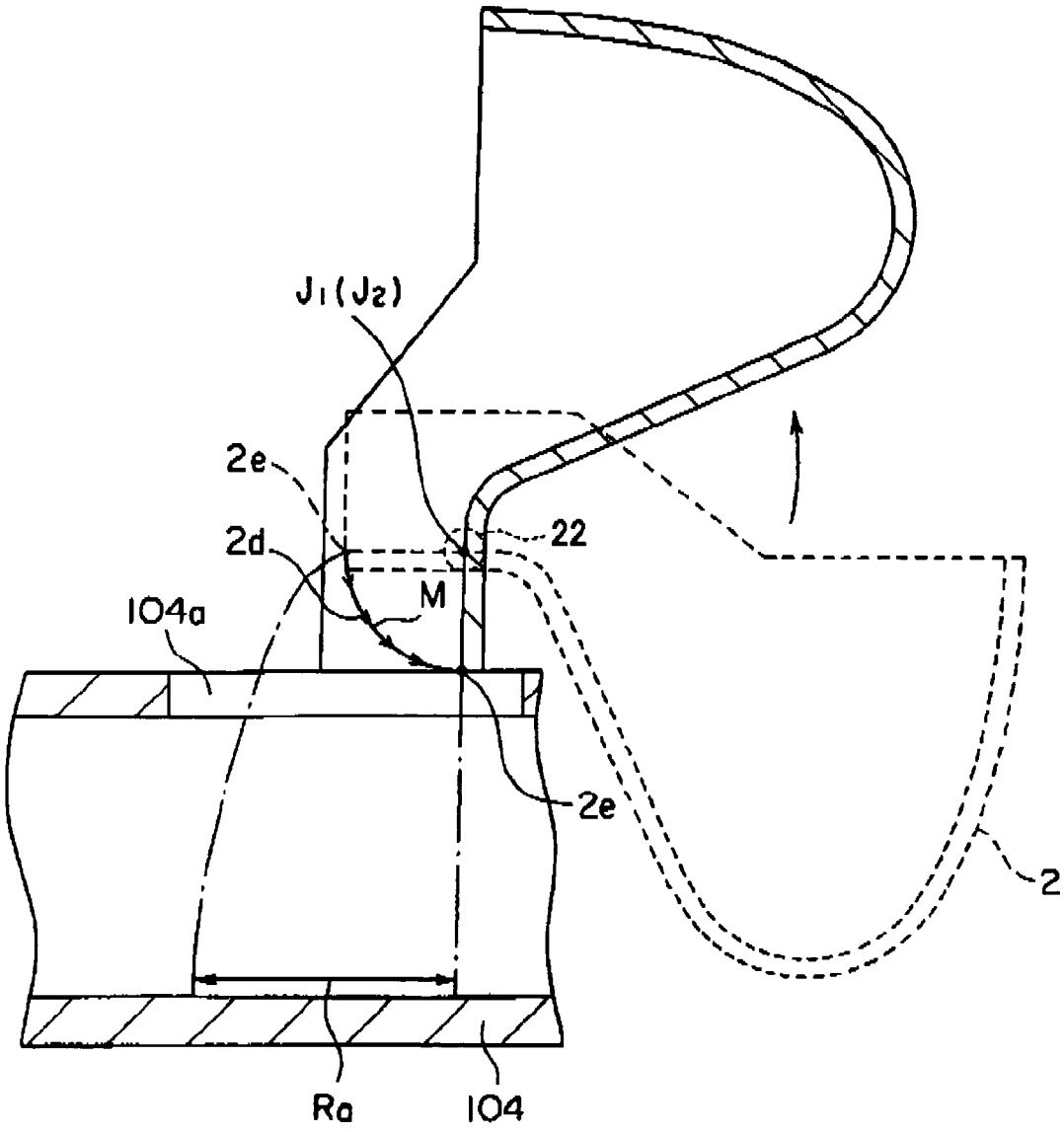
FIG. 6 is a view for explaining a drop area of molten metal dropping from a ladle to a sleeve.

FIG. 6 is a view for explaining the drop area of the molten metal ML dropping from the ladle 2 to the sleeve 104. If the ladle 2 is rotated 90 degrees about the axial line J1 of the mounting shaft 22 from the horizontal posture shown in FIG. 5, as shown in FIG. 6, th front end 2*e* of the pouring spout 2*d* of the ladle 2 moves on the path M. Therefore, the drop start position or the molten metal ML held in the ladle 2 changes in accordance with the tilt angle of the ladle 2. The molten metal ML for example drops in the area Ra of the sleeve 104 in FIG. 6. This area Ra becomes a relatively broad area since the front end 2*e* of the pouring spout 2*d* of the ladle 2 moves on the path M.

In this way, in the present embodiment, by deliberately providing the front end 2*e* of the pouring spout 2*d* of the ladle 2 at a position different from the mounting shaft 22 of the conveyor system 30, the drop position of the high temperature molten metal ML into the sleeve 103 is spread wider. That is, by offsetting the front end 2*e* of the pouring spout 2*d* of the ladle 2 from the axial line J1 of the mounting shaft 22 of the rotary shaft for tilting the ladle 2, the drop area of the high temperature molten metal ML into the sleeve 104 is enlarged. As a result, high temperature molten metal ML does not concentrate at any specific location of the sleeve 104, damage to only a specific location of the sleeve 104 can be prevented, and the lifetime of the sleeve 104 can be extended.

Second Embodiment

Next, a molten metal feed apparatus according to another embodiment of the present invention will be explained. The molten metal feed apparatus according to the present embodiment has a conveyor system and a ladle similar in basic structures of these with the first embodiment. Different components will be explained.

Figure 7A:
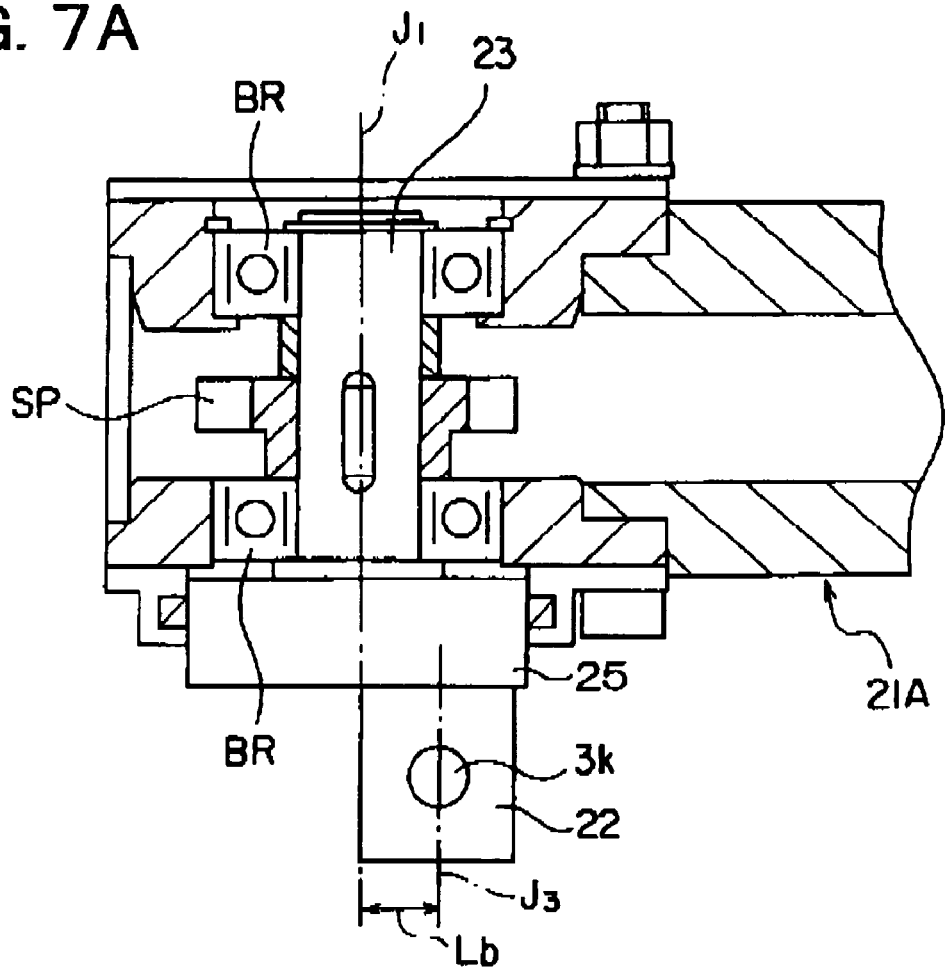
Figure 7B:
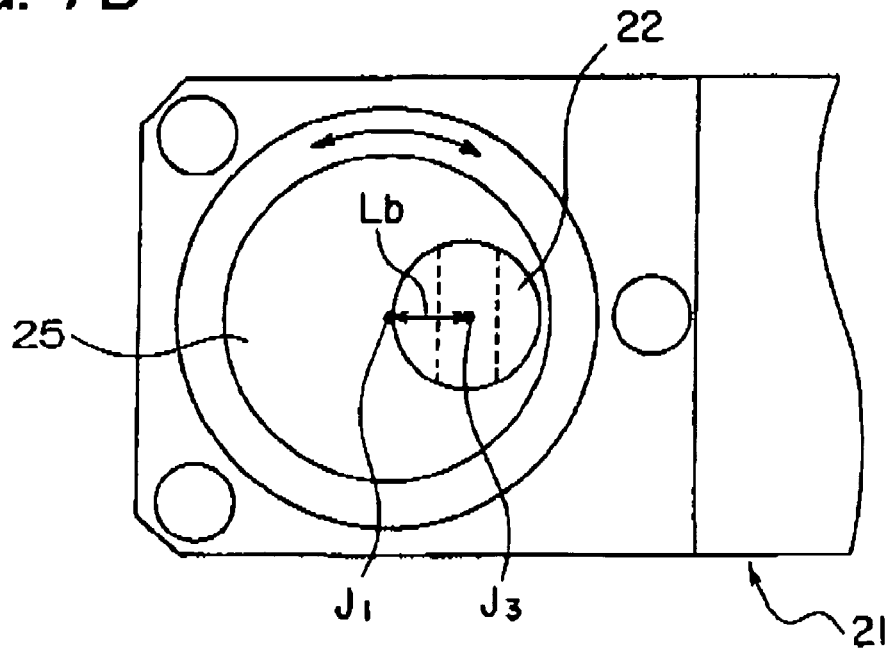
FIG. 7B is a side view seen from a direction A of FIG. 7A.

FIG. 7A is a cross-sectional view of the structure of the front end of the fifth arm 21A of the conveyor system according to the present embodiment taken along the longitudinal direction of the fifth arm 21A, while FIG. 7B is a side view seen from the direction of the arrow A of FIG. 7A. As shown in FIGS. 7A and 7B, one end of the rotary shaft 23 is formed with a flange 25. This flange 25 is formed with a mounting shaft 22. The mounting shaft 22 is formed with a pin hole 3*k* in its diametrical direction. As shown in FIGS. 7A and 7B, the axial line J1 of the rotary shaft 23 and the axial line J3 of the mounting shaft 22 are apart by exactly the distance Lb. That is, the axial line J3 of the mounting shaft 2 is offset from the axial line J1 of the rotary shaft 23.

Figure 8A:
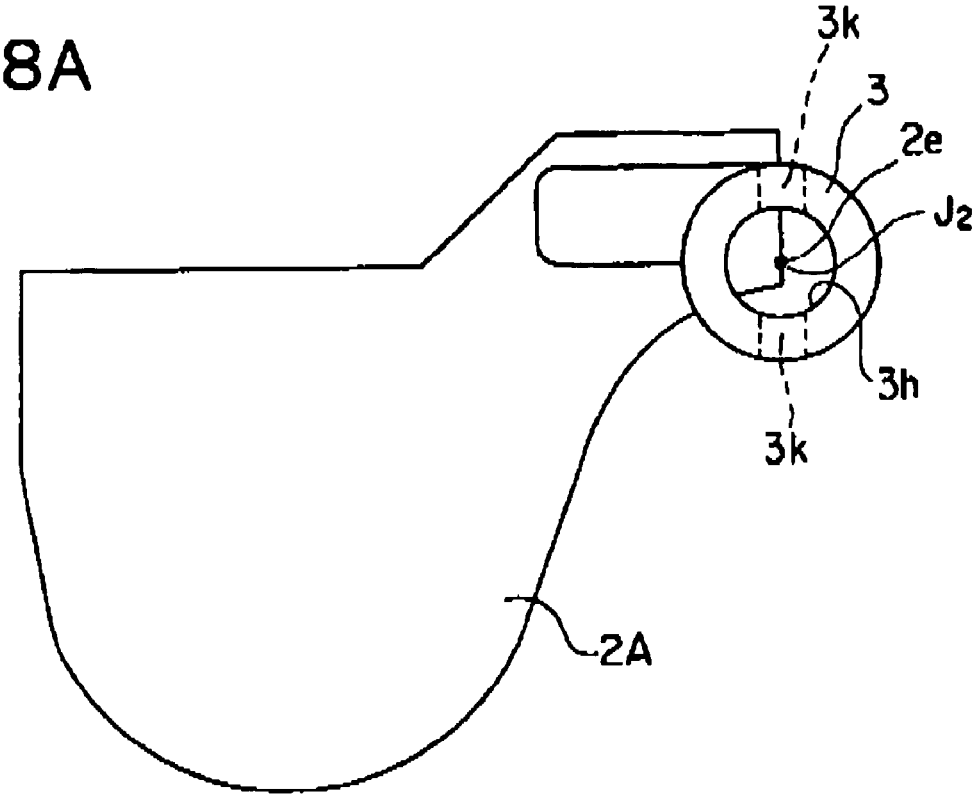
Figure 8B:
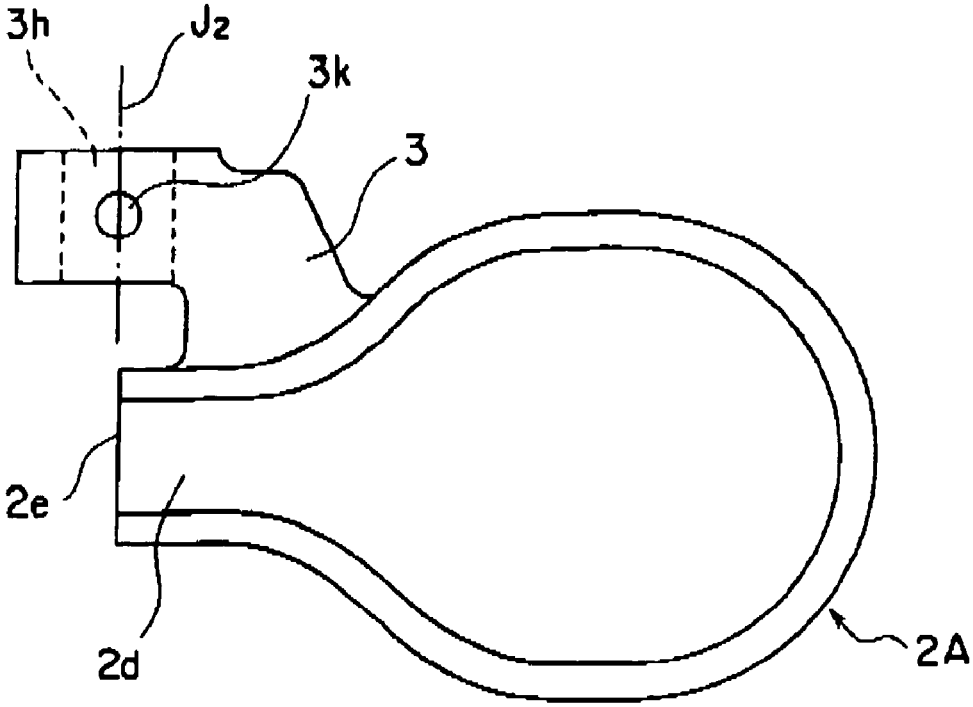
FIG. 8B is a top view.

FIG. 8A is a side view of the structure of the ladle 2A used for the molten metal feed apparatus of the present embodiment seen from the mounting shaft 22 side, while FIG. 8B is a top view. As shown in FIGS. 8A and 8B, the basic structure of the ladle 2A is the same as that of the first embodiment, but the ladle 2A differs in the point that the front end 2*e* of the pouring spout 2*d* is substantially positioned on the axial line J2 of the mounting hole 3*h*.

Figure 9:
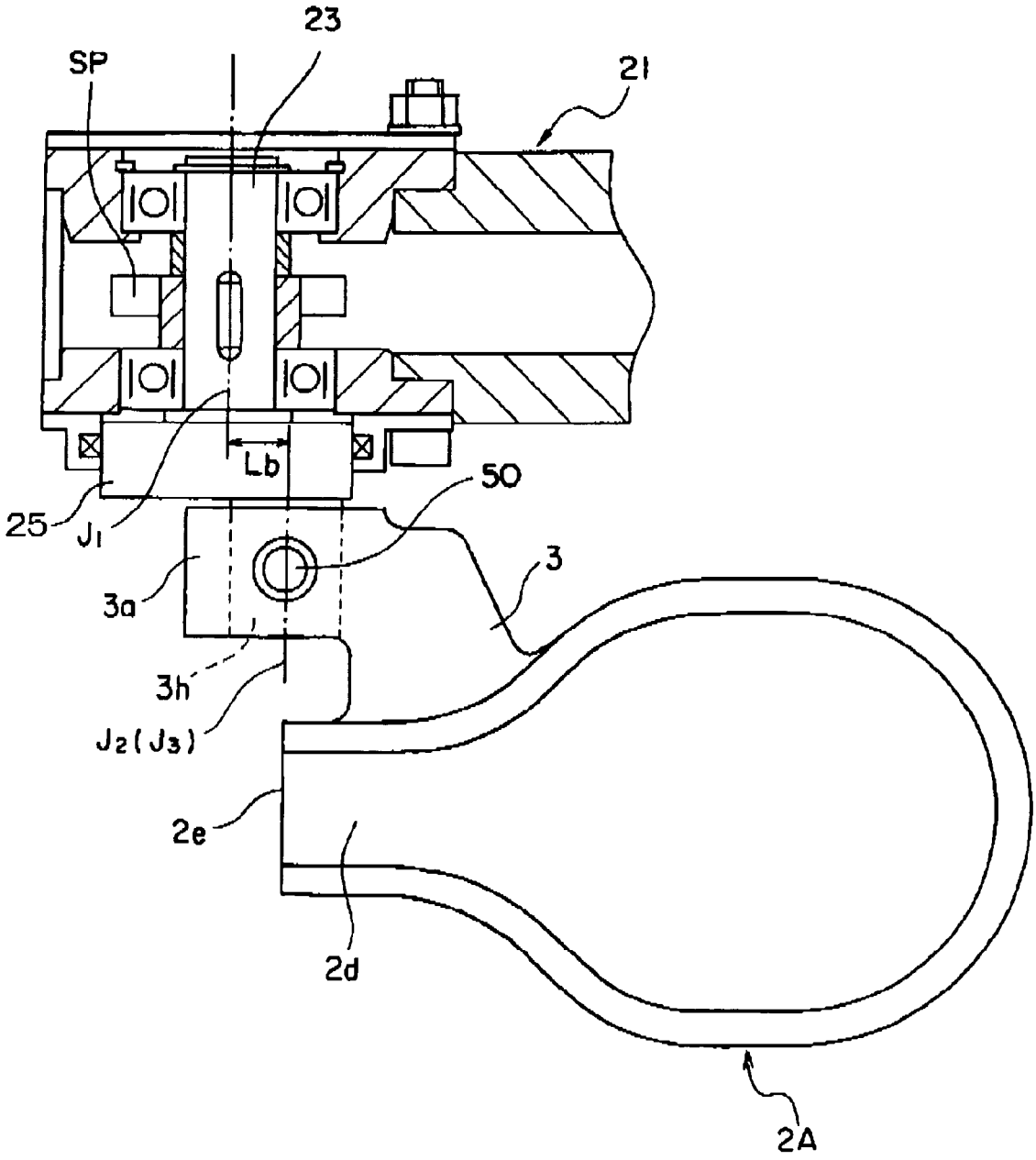
FIG. 9 is a view of the state of a ladle mounted on a mounting shaft 22 of a conveyor system.

FIG. 9 is a view of the state of the ladle 2A of the above configuration mounted on the mounting shaft 22 of the conveyor system. As shown in FIG. 9, the axial line J2 of the mounting shaft 3*h* and the axial line J3 of the mounting shaft 22 match. Therefore, the axial line J1 of the rotary shaft 23 and the front end 2*e* of the pouring spout 2*d* of the ladle 2A are apart by exactly a predetermined distance Lb. If the axial line J1 of the rotary shaft 23 and the front end 2*e* of the pouring spout 2*d* of the ladle 2A are apart by exactly the predetermined distance Lb, when the rotary shaft 23 rotates, the front end 2*e* will move on a circle having a radius of the predetermined distance Lb. As a result, the drop start position of the molten metal ML housed in the ladle 2A will change in accordance with the tilt angle of the ladle 2A. If the drop start position changes in accordance with the tilt angle of the ladle 2A, the drop area of the high temperature molten metal ML into the sleeve 104 is enlarged. As a result, high temperature molten metal ML does not concentrate at any specific location of the sleeve 104, damage to only a specific location of the sleeve 104 can be prevented, and the lifetime of the sleeve 104 can be extended.

In this way, according to the present embodiment, by separating the axial line J1 of the rotary shaft 23 and the axial line J3 of the mounting shaft 22 and arranging the front end 2*e* of the pouring spout 2*d* on the axial line J2 of the mounting hole 3*h*, similar effects as in the first embodiment are obtained.

Third Embodiment

Figure 10:
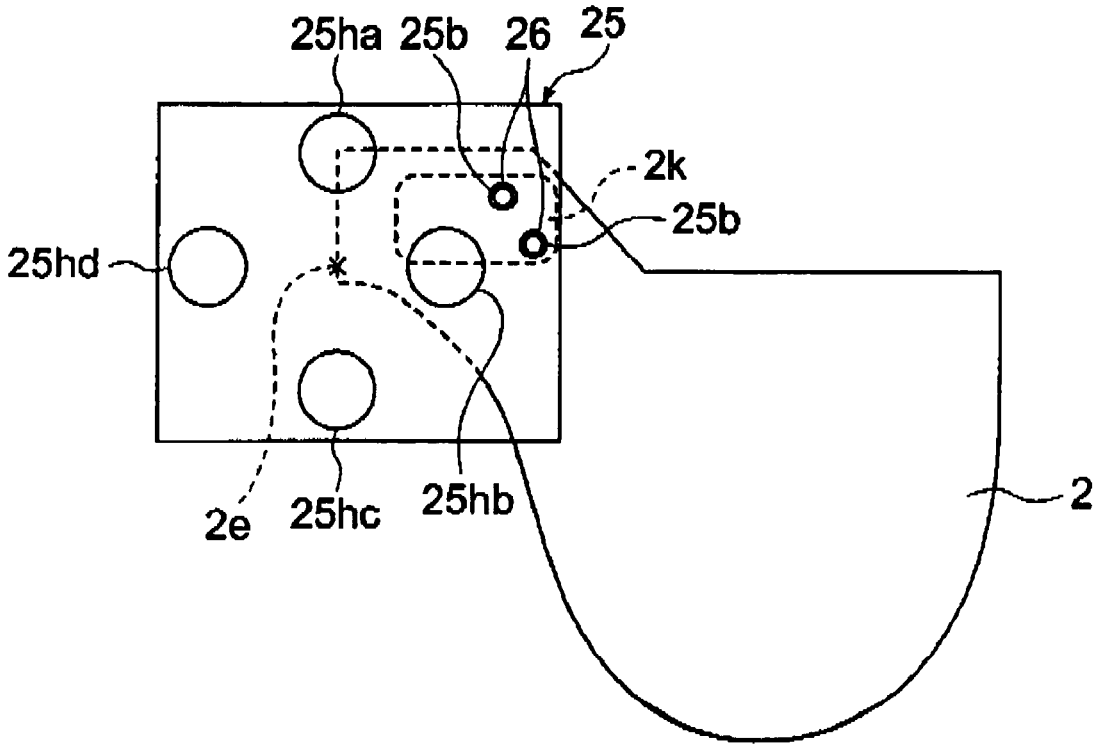
FIG. 10 is a view for explaining a coupling member in a molten metal teed apparatus according to a third embodiment of the present invention.

Next, a molten metal feed apparatus according to still another embodiment of the present invention will be explained. In the first embodiment explained above, the positional relationship between the rotary shaft 23 and the ladle 2 was fixed. In the present embodiment, as shown in FIG. 10, a connection plate 25 is interposed between the rotary shaft 23 (mounting shaft 22) and ladle 2 and the connection plate 25 is provided with a plurality of mounting holes 25*ha* to 25*hd*, whereby the positional relationship between the front end 2*e* of the pouring spout of the ladle 2 and the axial line J1 of the rotary shaft 23 can be changed.

Specifically, the connection plate 25 is formed with mounting holes 25*ha* to 25*hd* enabling insertion of the rotary shaft 22 at four different locations concentrically about the front end 2*e* of the pouring spout 2*d* of the ladle 2. By periodic rotation among the rotary shaft 23 (mounting shaft 22) and connection holes 25*ha* to 25*hd*, the range of movement of the front end 2*e* of the pouring spout 2*d* of the ladle 2 can be further changed and the drop area of the high temperature molten metal from the ladle 2 to the sleeve 104 can be further enlarged and spread.

Fourth Embodiment

Figure 11:
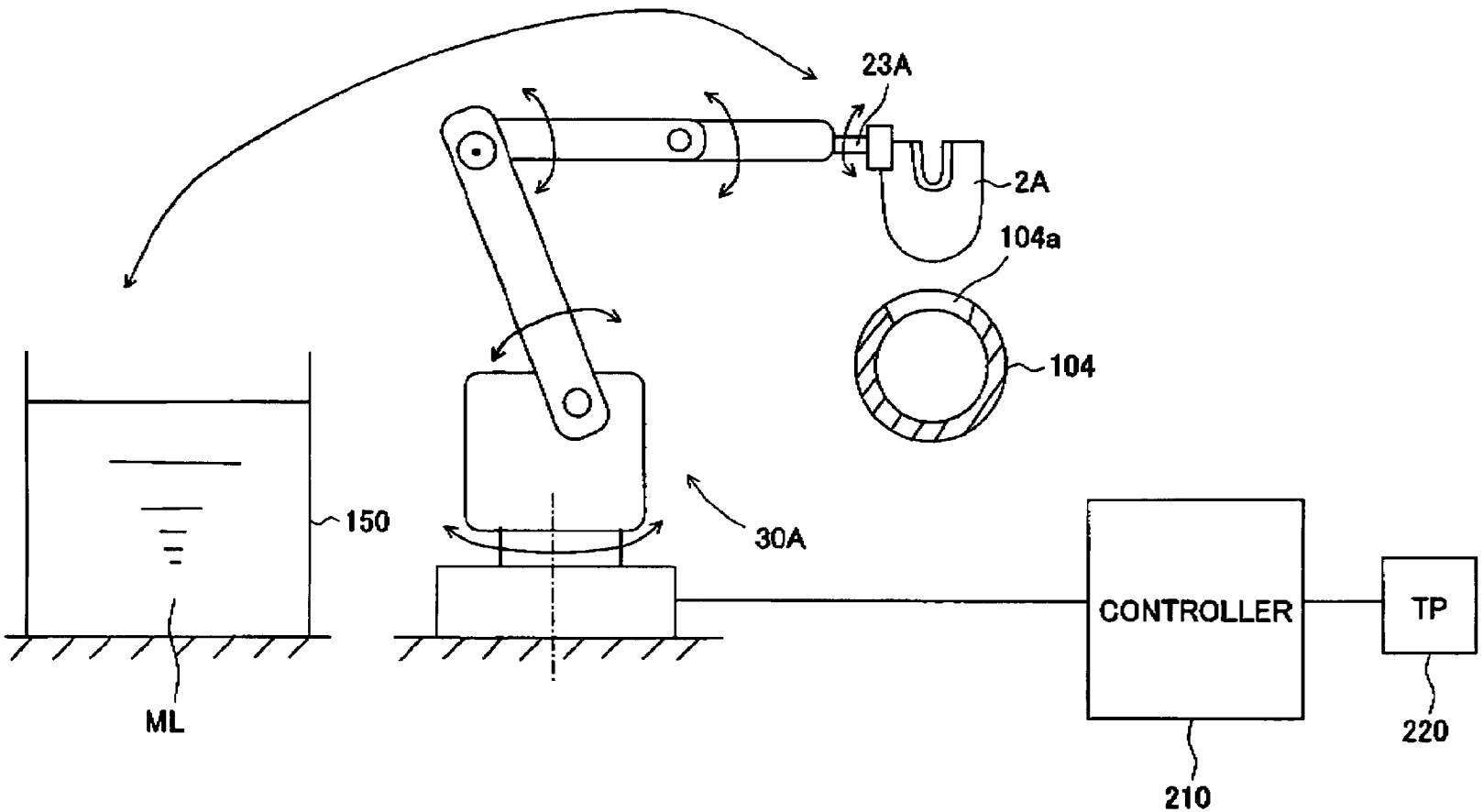
FIG. 11 is a view for explaining a molten metal feed apparatus and molten metal food method according to a third embodiment of the present invention.

FIG. 11 is a view for explaining a molten metal feed apparatus and molten metal feed method of a die casting machine according to still another embodiment of the present invention. As shown in FIG. 11, in the present embodiment, use is made of a general use industrial robot as the conveyor system 30A for holding and conveying the ladle 2A. The conveyor system 30A is a five-axis multiarticulated robot and has a rotary shaft 23A at the front end of its arm. This rotary shaft 23A is coupled with the ladle PA explained in the second embodiment.

The conveyor system 30A is controlled by a controller 210. The controller 210 is connected to a teaching pendant 220. This teaching pendant 220 may be used to teach the controller 210 of the conveyor system 30A a desired operation and store it. In the present embodiment, the operation of using the ladle 2A to scoop up molten metal in the melting furnace 150, conveying the ladle 2A to a predetermined feed position of the sleeve 104 of the die casting machine, and tilting the ladle 2A to pour the scooped up molten metal into the sleeve 104 is taught. Since the conveyor system 30A can be taught the desired operation, to enlarge the drop area of the molten metal into the sleeve 104, it is for example possible to perform the operation as shown in FIG. 12.

Figure 12:
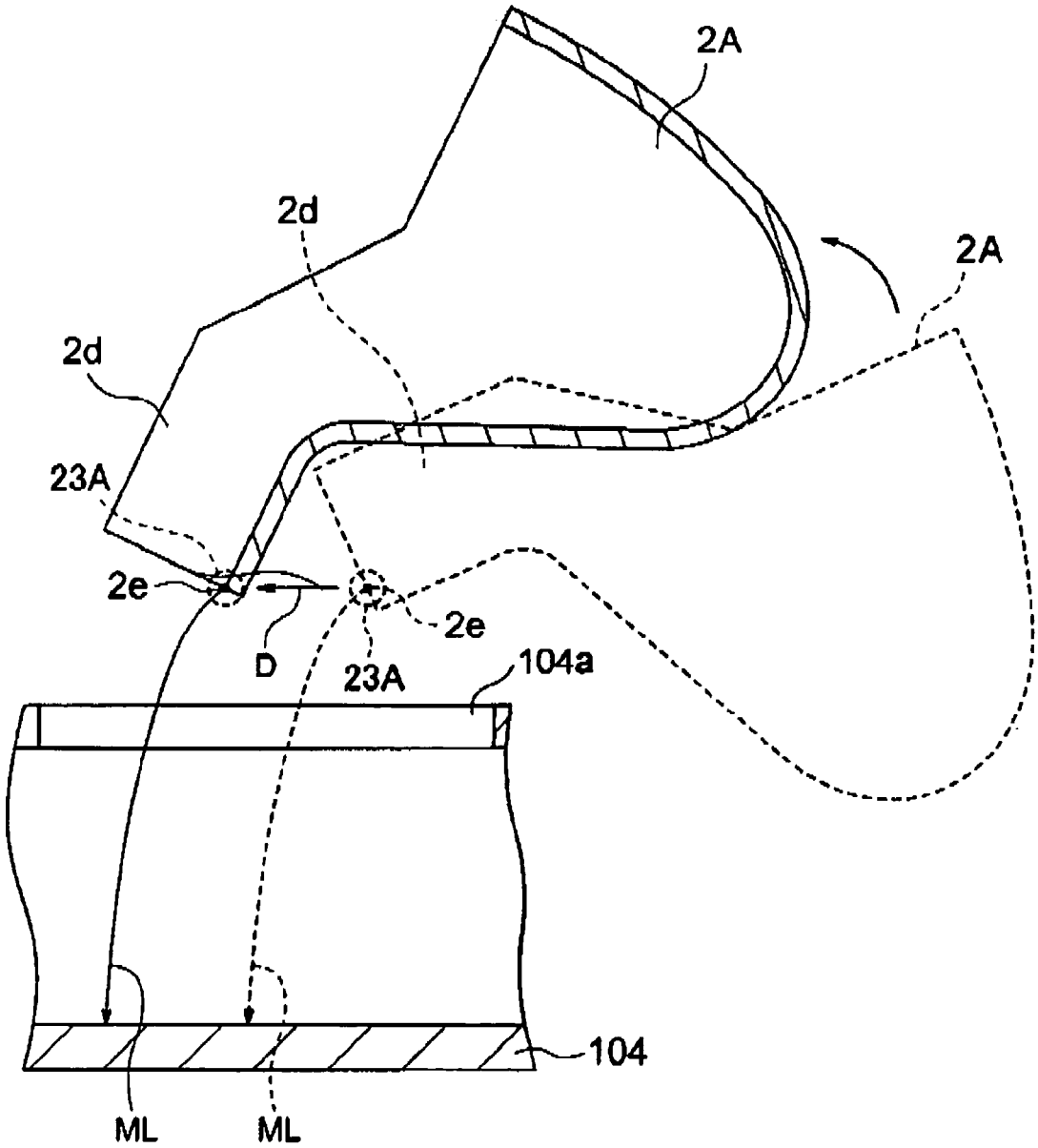
FIG. 12 is a view for explaining a feed operation of molten metal to a sleeve.

As shown in FIG. 12, when feeding molten metal ML into the sleeve 104, the ladle 2A is tilted about the rotary shaft 23A while moving the feed position of the ladle 2A in the direction shown by the arrow D. That is, simultaneously with tilting the ladle 2A, the conveyor system 30A is used to move the feed position of the ladle 2A. Due to this, it is possible to change the position of the front end 2*e* of the pouring spout of the ladle 104 with respect to the sleeve 104 while pouring molten metal ML into the sleeve 104. As a result, even if the position of the rotary shaft 23A is the same as the front end 2*e* of the pouring spout 2*d* of the ladle 2A, it is possible to enlarge the drop area of the molten metal ML dropping into the sleeve 104, whereby local heating of the sleeve 104 is prevented and the lifetime of the sleeve 104 can be extended.

According to the present embodiment, by using a general us industrial robot, it is possible to freely and easily change the path of conveyance of the ladle 2A. Further, adjustment of the drop area of the molten metal ML dropping into the sleeve 104 is easy. Note that while the present embodiment was explained with reference to the case of use of a ladle 2A with a position of the front end 2*e* of the pouring spout 2*d* substantially identical to the axial line of the rotary shaft, it is also possible to use a ladle with a front end 2*e* of the pouring spout 2*d* positioned away from the axial line of the rotary shaft like in the ladle 2 according to the first embodiment.

Fifth Embodiment

Figure 13:
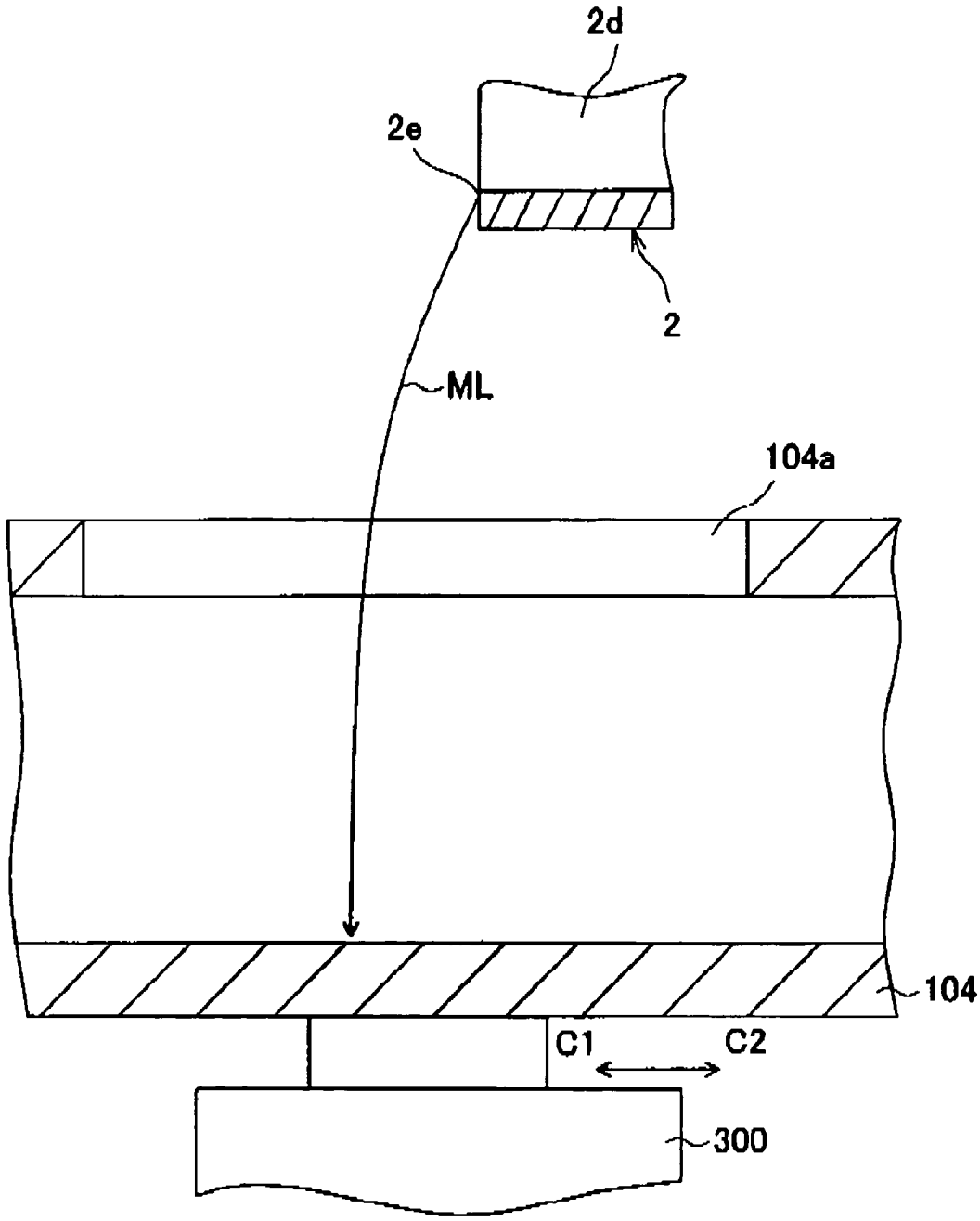
FIG. 13 is a view for explaining a molten metal feed method of a die casting machine according to a fourth embodiment of the present invention.

Next, a molten metal feed apparatus of a die casting machine according to still another embodiment of the present invention will be explained with reference to FIG. 13. In FIG. 13, a movement mechanism 300 for moving the sleeve 104 in the longitudinal directions C1 and C2 is provided at the die casting machine. When tilting the ladle 2 to pour molten metal ML into the sleeve 104, this movement mechanism 300 makes the sleeve 104 for example move back and forth in the longitudinal directions C1 and C2. Due to this, it is possible to expand the drop area of the molten metal ML dropping into the sleeve 104, whereby local heating of the sleeve 104 is prevented and th lifetime of the sleeve 104 can be extended. Further, by using a ladle 2 with a front end 2*e* of a pouring spout positioned away from the axial line of the rotary shaft to which the ladle is coupled, the drop area of the molten metal ML in the sleeve 104 can be further enlarged.

While the invention has been described with reference to specific embodiments chosen for purpose or illustration, it should be apparent that numerous modifications could be made thereto by those skilled in the art without departing from the basic concept and scope of the invention.

What is claimed is:

1. A molten metal feed apparatus of a die casting machine comprising:

a ladle having a receptacle for holding a molten metal, and an elongated pouring spout for pouring the molten metal;

a conveying means for conveying said ladle to a predetermined feed position of a sleeve of the die casting machine, tilting the ladle, and pouring the scooped up molten metal into said sleeve, having a rotary shaft coupled with said ladle and turning so as to tilt said ladle at said predetermined feed position; and a position changing means for changing a position of a front end of the pouring spout of said ladle with respect to said sleeve in accordance with a change in posture of said ladle while pouring the molten metal into said sleeve, said front end of the elongated pouring spout of the ladle being apart from an axial line of said rotary shaft.

2. A molten metal feed apparatus as set forth in claim 1, wherein the receptacle has a flat top wall opened for pouring the molten metal, the elongated pouring spout for pouring out molten metal held in said receptacle, is continuously connected to the receptacle, and has a flat bottom and two parallel walls connected to the flat bottom, and said ladle comprises a mounting portion fixed to a portion between one side wall of the pouring spout and one side wall of the receptacle said mounting portion having a mounting hole directing a direction substantially perpendicular to the one side wall of the pouring spout, and positioned substantially the same horizontal position of the flat bottom of the pouring spout, to which a shaft is to be attached for rotating the ladle, the front end of the elongated pouring spout is apart from an axial line of the mounting hole, and the flat bottom of the pouring spout is substantially the same level or higher than the flat top of the wall of the receptacle.

3. A molten metal feed apparatus as set forth in claim 1, further comprising a coupling member able to change a positional relationship between the front end of the pouring spout of said ladle and the axial line of said rotary shaft.

4. A molten metal feed apparatus of a die casting machine, comprising:

a ladle having a receptacle for holding a molten metal and a pouring spout for pouring the molten metal;

a conveying means for conveying said ladle to a predetermined feed position of a sleeve of the die casting machine, tilting the ladle, and pouring the scooped up molten metal into said sleeve, having a rotary shaft turning so as to tilt said ladle at said predetermined feed position and a mounting shaft coupled with said rotary shaft and arranged at a position offset from said rotary shaft, a position changing means for changing a position of a front end of the pouring spout of said ladle with respect to said sleeve in accordance with a change in posture of said ladle while pouring the molten metal into said sleeve by tilting the ladle, said ladle having a mounting hole in which said mounting shaft is inserted, and a front end of the pouring spout of said ladle is positioned substantially on a center line of said mounting hole.

5. A molten metal feed method of a die casting machine comprising:

scooping up molten metal by a ladle held by a conveyor system, said ladle comprising a receptacle for holding the molten metal; and an elongated pouring spout for pouring out molten metal held in said receptacle, continuously connected to the receptacle, and a mounting portion fixed to a portion between one side wall of the pouring spout and one side wall of receptacle having a mounting hole directing a direction substantially perpendicular to the wall of the pouring spout, to which a shaft is to be attached for rotating the ladle, a front end of the pouring spout being apart from an axial line of the mounting hole, and a flat bottom of the pouring spout being substantially the same level or higher than a flat top of the wall of the receptacle, conveying said ladle to a predetermined feed position of a sleeve of the die casting machine;

pouring the scooped up molten metal in the receptacle into said sleeve through the pouring spout by tilting said ladle with respect to the mounting hole; and changing a position of the front end of the pouring spout of said ladle with respect to said sleeve in accordance with a change in posture of said ladle while tilting said ladle to pour the molten metal into said sleeve.

6. A molten metal feed method as set forth in claim 5, wherein:

the receptacle for holding the molten metal has a flat top wall opened for pouring the molten metal thereinto;

the elongated pouring spout for pouring out molten metal held in said receptacle, is continuously connected to the receptacle, and has a flat bottom and two parallel walls connected the flat bottom; and the mounting hole is positioned substantially the same horizontal position of the flat bottom of the pouring spout, the front end of the elongated pouring spout is apart from an axial line of the mounting hole, and the flat bottom of the pouring spout is substantial the same level or higher than the flat top of the wall of the receptacle.

7. A molten metal feed method as set forth in claim 5, wherein a general use industrial robot able to be taught a conveyance path and tilt operation of said ladle is used for said conveying system.

8. A ladle used for feeding molten metal to a sleeve of a die casting machine, comprising:

a receptacle for holding the molten metal having a flat top opened for pouring the molten metal thereinto, and an elongated pouring spout for pouring out molten metal held in said receptacle, continuously connected to the receptacle, having a flat bottom and two parallel walls connected to the flat bottom; and a mounting portion fixed to a portion between one side wall of the pouring spout and one side wall of receptacle, having a mounting hole directing a direction substantially perpendicular to the wall of the pouring spout, and positioned substantially the same horizontal position of the flat bottom of the pouring spout to which a shaft is to be attached for rotating the ladle, a front end of the elongated pouring spout being apart from an axial line of the mounting hole, and the flat bottom of the elongated pouring spout being substantially the same level or higher than the flat top of the wall of the receptacle.

* * * * *